US005468031A

United States Patent [19]

Holmgren

[11] Patent Number: 5,468,031

[45] Date of Patent: Nov. 21, 1995

[54] LOCK MECHANISM

[75] Inventor: Bertil Holmgren, Vellinge, Sweden

[73] Assignee: MW Trading APS, Glyngore, Denmark

[21] Appl. No.: 137,177

[22] PCT Filed: Apr. 22, 1992

[86] PCT No.: PCT/SE92/00259

§ 371 Date: Dec. 27, 1993

§ 102(e) Date: Dec. 27, 1993

[87] PCT Pub. No.: WO92/18734

PCT Pub. Date: Oct. 29, 1992

[30] Foreign Application Priority Data

Apr. 23, 1991 [AU] Australia ..... 75230/91

[51] Int. Cl.[6] ..... E05C 19/06

[52] U.S. Cl. ..... 292/81; 292/251.5; 292/307 B; 292/201; 70/63; 206/309

[58] Field of Search ..... 292/307 R, 251.5, 292/327, 307 B, 317, 329, 328, 81, 80, 201; 70/63; 206/309

[56] References Cited

U.S. PATENT DOCUMENTS

| | | | |
|---|---|---|---|
| 281,268 | 7/1883 | Haskell | 292/80 X |
| D. 313,412 | 1/1991 | Holmgren . | |
| 767,298 | 8/1904 | Louis | 292/201 |
| 1,664,500 | 4/1928 | Bates | 292/80 X |
| 2,516,994 | 8/1950 | Holt | 292/201 X |
| 3,848,907 | 11/1974 | Shiurila . | |
| 4,280,724 | 7/1981 | Dalton . | |
| 4,819,797 | 4/1989 | Holmgren . | |
| 4,966,020 | 10/1990 | Fotheringham . | |
| 5,209,086 | 5/1993 | Bruhwiler | 70/63 X |
| 5,289,914 | 3/1994 | Holmgren | 206/309 X |

FOREIGN PATENT DOCUMENTS

| | | | |
|---|---|---|---|
| 0312172 | 4/1989 | European Pat. Off. . | |
| 230920 | 2/1911 | Germany | 292/80 |
| 461121 | 1/1990 | Sweden . | |
| 18859 | of 1899 | United Kingdom | 292/201 |

*Primary Examiner*—Rodney M. Lindsey
*Attorney, Agent, or Firm*—Merchant, Gould, Smith, Edell, Welter & Schmidt

[57] ABSTRACT

A lock mechanism including a lock member which is normally held in an engaged position to be magnetically operated from said engaged position to a disengaged position, said lock member comprising a spring blade and an engagement member projecting therefrom transversely to the flat side of the spring blade at one end thereof, the spring blade being fixedly secured at the other end thereof, and a safety device for CD boxes having such a lock mechanism.

3 Claims, 2 Drawing Sheets

LOCK MECHANISM

BACKGROUND OF THE INVENTION

The present invention relates to a lock mechanism comprising a lock member which is normally held in an engaged position to be magnetically operated from said engaged position to a disengaged position.

The lock mechanism of the invention has been developed particularly for a safety device for boxes for compact discs, which is used in the retail trade for blocking the box so that it cannot be opened easily for theft of the compact disc, or such theft in any case cannot take place without considerable difficulties. In one safety device which has appeared on the market in order to protect boxes for compact discs the lock mechanism is of the type referred to and comprises a metal pin guided for reciprocating movement and biassed to the engaged position by a helical spring said pin being provided with a metal head which is attracted by a magnet when it is desired to disengage the lock mechanism. In the engaged position the pin engages an aperture provided in one of the narrow sides of the box. This prior art lock mechanism is safe and reliable, but it is rather expensive in manufacture.

In the compact disc retail trade there is a desire of minimizing the costs and efforts for protecting the compact discs against theft, and accordingly there is a demand for cheap protecting devices, which are easy to handle in the retail store and provide an acceptable protection of the compact discs, which means that there is a demand for a cheap and effective lock mechanism for use with such protecting devices.

SUMMARY OF THE INVENTION

The invention provides a lock mechanism of the type referred to above which combines safety with simplicity and low manufacturing costs, wherein the lock member comprises a spring blade an engagement member projecting therefrom transversely to the flat side of the spring blade at one end thereof, the spring blade being fixedly secured at the other end thereof.

BRIEF DESCRIPTION OF THE DRAWINGS

In order to explain the invention in more detail an embodiment thereof will be described below reference being made to the accompanying drawings in which.

DETAILED DESCRIPTION OF THE PREFERRED EMBODIMENT

Figure 1:
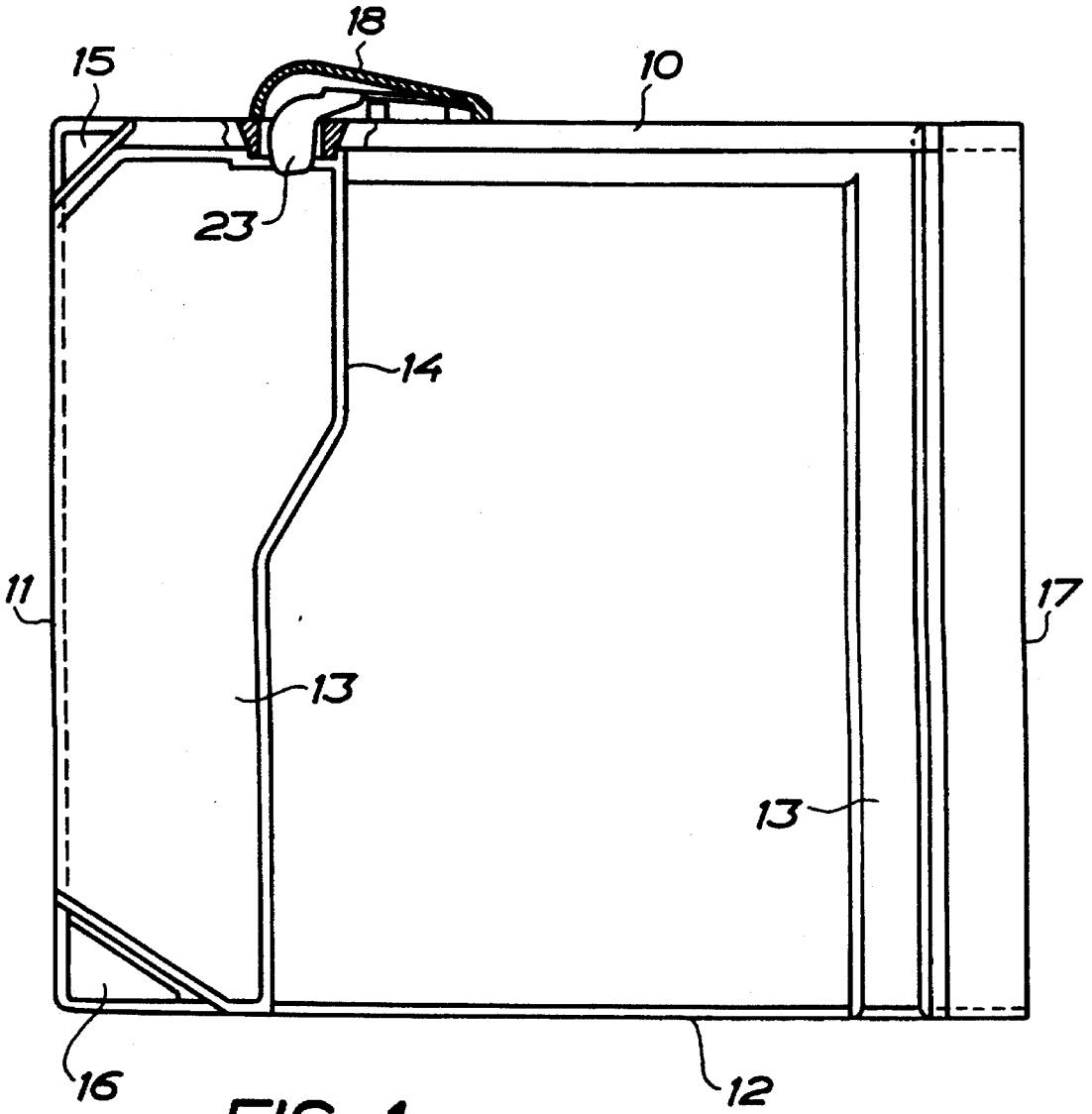
FIG. 1 is a side view, partly a vertical cross-sectional view, of a safety device with the lock mechanism of the invention

The safety device disclosed in the drawings is intended for a box for a compact disc (CD). It is injection molded of plastics material, for example polycarbonate, which is a strong and for the purpose well suited plastics material. Preferably, the plastics material is crystal-clear. The device is formed as a flat rectangular frame having three walls 10, 11 and 12 which form narrow sides of the frame, a wall 13 at one flat side of the frame, forming an opening 14, and two triangular corner portions 15 and 16 and a rail 17 at the other flat side of the frame, said triangular corner portions connecting the walls 10, 11 and 11, 12, respectively, the rail 17 being located at the narrow side having no wall. At the open narrow side of the frame the wall 13 is retracted in the longitudinal direction of the walls 10 and 11 in relation to the rail 17 for productional reasons, and for the same reasons apertures congruent with the corner portions, are provided in the wall 13. The frame is provided with one or more sensors (not shown) for affecting an electric alarm system when the safety device is carried through the exit of a retail store.

The CD-box is inserted into the safety device by being pushed leftwards as seen in FIG. 1 into the frame through the open narrow side to the right in FIG. 1. When the box is located in the frame it is encircled by the frame along three edges and at the two flat sides by the wall 13 at one flat side and by the corner portions 15 and 16 and the rail at the other flat side.

Figure 4:
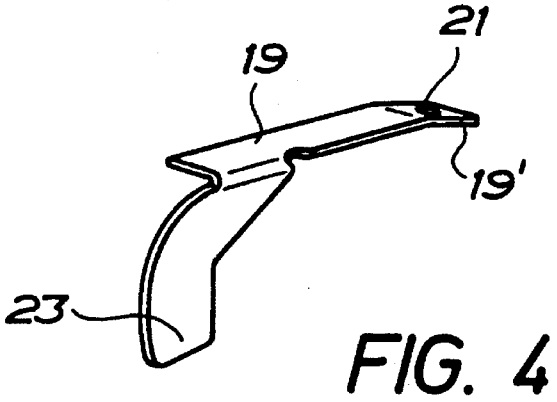
FIG. 4 is a perspective view of the spring with the engagement member forming an integral part thereof.

A lock mechanism for interlocking the frame and the CD box inserted into the frame comprises a spring blade 19 which forms a slightly angled end portion 19' which is supported on a pillar 20 projecting from the wall 10 of the frame and having a sloping upper surface the slope of which is adapted to the shape of the housing 18. The end portion 19' forms an aperture 21, and the spring is clamped between said sloping surface of the pillar 20 and the inside surface of the housing 18, a small protuberance 22 on the sloping surface of the pillar penetrating through the aperture 21 into a recess in the inside surface of the housing. The spring blade at the other end thereof has a flap 23 forming an integral part of the spring blade 19 and extending downwards transversely of the flat side of the spring blade substantially perpendicularly to said surface. As will be seen from the drawings the flap 23 has L-shape as seen in side view one limb of the L connecting to the spring blade and the other limb projecting downwards. Furthermore, the flap is slightly curved between the end connecting to the spring blade and the free end of the flap so that the free end is located in a plane transverse to the flat surface of the spring blade, substantially midway between the side edges of the spring blade, as will be seen in FIG. 4. The flap 23 forms the engagement member of the lock mechanism, and as will be seen it extends through an aperture 24 in the wall 10 of the frame. Normally the spring blade takes the position shown in FIGS. 1 and 2, the flap 23 projecting from the lower side of the wall 10.

A box for a compact disc usually on one half thereof has two laps for the retention of a printed insert of paper or plastics having a decoration and/or information on the disc in the cassette, and for productional reasons the narrow side of the cassette at each lap forms an aperture. An aperture of this type is utilized in the safety device of the invention for positive engagement between the frame and the engagement member by said member engaging the aperture when in the position according to FIGS. 1 and 2. The frame thus is locked to the box and prevents the box from being opened for removal of the disc therefrom.

Figure 2:
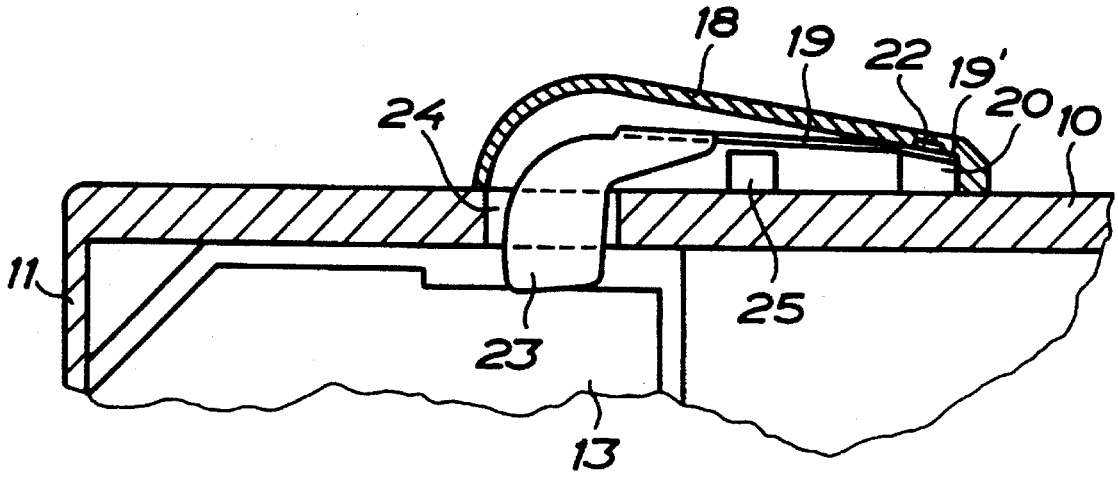
FIG. 2 is a fragmentary vertical cross-sectional view of the lock mechanism when it is in the engaged position.

When the box is being slid into the frame from the right as seen in FIGS. 1 and 2 the flap 23 will be pushed away by the box against the bias of the spring blade and then, when in register with the aperture in the CD box, will lockingly snap into said aperture under the bias of the spring blade. The frame is thus locked to the box and prevents the box from being opened for removal of the disc therefrom. The spring blade should be so stiff that in the engaged position the flap 23 cannot be cammed from the aperture in the CD box under bending of the spring blade if one is trying to slide the box manually out of the frame to the right as seen in FIGS. 1 and 2 with the lock mechanism in the engaged position. Every effort to do this will result in the spring blade being bent downwards against an abutment 25 projecting from the wall 10 of the frame, and the flap 23 being pressed against the right hand bounding surface of the aperture 24.

Figure 3:
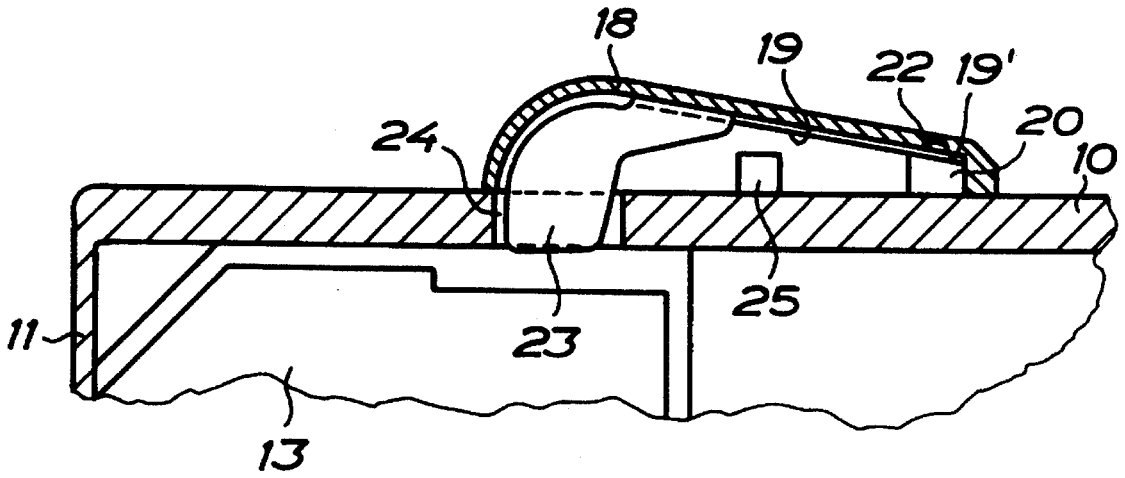
FIG. 3 is a view corresponding to FIG. 2 showing the lock mechanism in the disengaged position.

Displacement of the flap 23 to the disengaged position in FIG. 3 is effected by attracting the spring blade by a magnet which is advanced from above towards the lock housing from the outside thereof. Due to the stiffness of the spring blade a very strong electric magnet or a permanent magnet of high-quality magnet material is required in order to bring the spring blade to the position according to FIG. 3; it should not be possible to use any simple permanent magnet for the purpose. In the position according to FIG. 3 the flap 23 is withdrawn from the aperture in the cassette. Then, the cassette is free to be withdrawn from the safety device. This operation should of course be performed by an authorized person only, viz. the shop attendant when the product protected by the safety device is being sold.

Though developed particularly for use with a CD box protecting safety device the lock mechanism of the invention can be used also in devices of other kinds in order to lock two independent elements against relative displacement the lock mechanism being mounted to one of said elements to engage the other one of said elements at the engagement member formed by the flap 23.

The illustrative embodiment described can be modified particularly with regard to the construction of the engagement member. Although shown here as an integral part of the spring blade the engagement element can be made as a separate element which is attached to the spring blade. E.g. the engagement member could be made as a pin attached to the spring blade and projecting from the lower side of the spring blade. However, the flap forming the engagement member in the embodiment described has been found to provide maximum safety against unauthorized removal of the CD box from the protecting frame of the safety device.

I claim:

1. Safety device for a box including two hingedly interconnected rectangular box halves, comprising:

a frame to be mounted on an outside of the box encircling the box to prevent opening thereof;

a flat spring blade of a material allowing the spring blade to be magnetically attracted;

means for fixedly mounting said spring blade to said frame at one end thereof, said spring blade projecting toward the other free end of the spring blade from said mounting means;

a flap being bent from said spring blade to project therefrom transversely of a plane of the spring blade at said other free end thereof towards an interior of said frame to lockingly engage a box encircled by the frame and thus to prevent removal of the frame from the box; and a housing enclosing said spring blade exteriorly of the frame, said flap being disengaged from the box by magnetically attracting said spring blade from the outside of said housing.

2. Safety device as in claim 1 wherein the flap is L-shaped as seen in side view thereof, one limb connecting to the spring blade the other one projecting therefrom.

3. Safety device as in claim 1 wherein the flap is curved so as to have the other free end thereof located in a plane transverse to a flat side of the spring blade, substantially midway between side edges of the spring blade.

* * * * *